United States Patent [19]

Rothen et al.

[11] 4,299,011

[45] Nov. 10, 1981

[54] WEB TAKE-OFF APPARATUS AT THE DOFFER OF A CARD

[75] Inventors: Hansjoerg Rothen, Ennetaach; Heinrich Rutschmann, Wiesendangen; Hans Rutz, Winterthur, all of Switzerland

[73] Assignee: Rieter Deutschland GmbH, Fed. Rep. of Germany

[21] Appl. No.: 142,060

[22] PCT Filed: Dec. 9, 1978

[86] PCT No.: PCT/EP78/00027

§ 371 Date: Aug. 24, 1979

§ 102(e) Date: Aug. 24, 1979

[87] PCT Pub. No.: WO79/00438

PCT Pub. Date: Jul. 12, 1979

[30] Foreign Application Priority Data

Dec. 27, 1977 [DE] Fed. Rep. of Germany ..... 2758337

[51] Int. Cl.[3] ..... D01G 15/46; D01G 15/96

[52] U.S. Cl. ..... 19/106 R; 19/65 CR

[58] Field of Search ..... 19/65 CR, 106 R, 150

[56] References Cited

U.S. PATENT DOCUMENTS

| | | | |
|---|---|---|---|
| 2,897,549 | 8/1959 | Paterson | 19/106 R |
| 3,341,900 | 9/1967 | Wildbolz et al. | 19/106 |

FOREIGN PATENT DOCUMENTS

| | | | |
|---|---|---|---|
| 1079182 | 8/1967 | United Kingdom | 19/106 R |
| 1438178 | 6/1976 | United Kingdom | 19/106 R |

*Primary Examiner*—Louis Rimrodt

*Attorney, Agent, or Firm*—Kenyon & Kenyon

[57] ABSTRACT

A card is equipped behind the doffer roll (7) with a pair of delivery rolls (8, 8*a*) for the web (9) provided each with a stationary grazing blade (12, 12*a*) for seed particles or similar impurities. Between the nip line K of the delivery rolls (8, 8*a*) and the grazing blades (12) of the delivery roll (8) a web deflecting roll (15) is supported rotatably and drivable in the same rotational direction as the delivery roll (8). The web deflecting device (15) is arranged of, but in the vicinity of, the normal free web exit path (9*a*) and brings a web (9*b*) possibly clinging to the delivery roll (8) and carried on thereon back to the normal web exit path (9*a*) and separates the web (9*b*) from impurities on the cylindrical surface. The impurities are only subsequently mechanically eliminated by the grazing blade (12), in such manner that the cleaning operation for the delivery roll (8) is effected in two subsequent separate cleaning steps.

17 Claims, 9 Drawing Figures

WEB TAKE-OFF APPARATUS AT THE DOFFER OF A CARD

Figure 1:
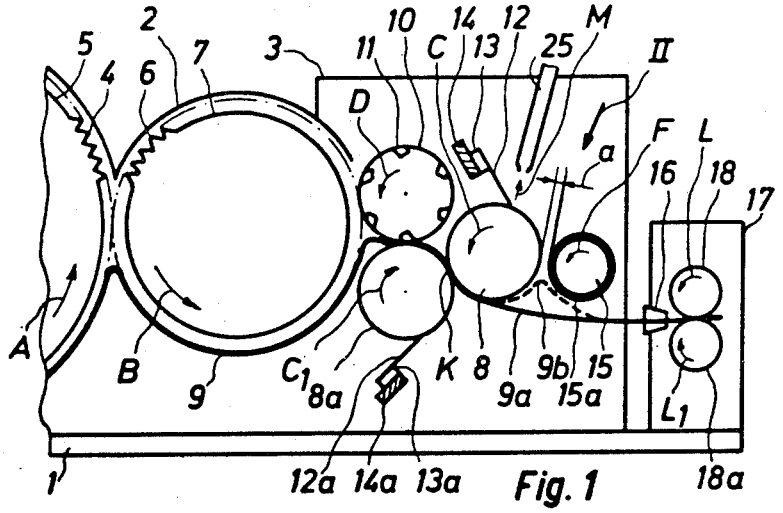

The present invention concerns a web take-off apparatus at the doffer of a card with a pair of delivery rolls forming a nip line for the web, arranged after the doffer roll, which at each delivery roll is provided with a stationary grazing blade, set closely to the cylindrical surface, for seed particles and similar impurities.

Using web take-off devices of the above mentioned type, as known e.g. from U.S. Pat. No. 3,341,900 or Russian Patent SU-PS No. 212.107, impurities stemming from the fiber material, such as e.g. seed particles or similar impurities, which upon delivery of the web from the nip line of the delivery rolls adhere to the delivery rolls, can be eliminated by the scraping or grazing blade from the cylindrical surface of the delivery rolls. However, it is not prevented that the emerging web sticks to one or the other delivery roll and is carried on thereon, in such manner that the web can be torn.

It thus is the object of the present invention to create a web take-off apparatus at the doffer of a card in which the disadvantages of the devices of such type known thus far can be eliminated.

It is another object of the invention to avoid tearing of a web which is doffed from a card by a take-off apparatus.

It is another object of the invention to eliminate any impurities sticking to the delivery rolls of a web take-off apparatus of a card.

Briefly, the invention provides a web take-off apparatus of the type mentioned initially which is characterised in that a web deflecting device is set to at least one delivery roll between the nip line and the grazing blade and outside of, but in the vicinity of, the normal, predetermined free web exit path at a distance of at least 0.1 mm.

In the web take-off apparatus according to the invention by the combination of web deflecting device and grazing blade, separation is achieved of the web if for any reason the web adheres to the delivery roll upon leaving the nip line and adheres to the impurities sticking to the cylinder surface. In this process, the impurities remaining on the delivery roll are eliminated mechanically subsequently only by the closely set grazing blade. Thus, cleaning of the delivery roll is effected, the deflection or separation of the web and subsequently the grazing of impurities being effected in sequence, i.e. the cleaning operation is effected in two subsequent but separated cleaning steps.

By suitably arranging the web deflecting device, the web which may otherwise be carried on a delivery roll can be brought back from a point in the vicinity of the normal free web exit path to the path, for example leading to a condenser with following take-off rolls. If the web deflecting device is provided e.g. on both delivery rolls, separation of a web carried on by either the delivery roll located above the nip line or by the one located below the nip line from the roll and from the impurities on the rolls is ensured.

The web take-off apparatus functions in particularly advantageous manner, if one of the delivery rolls is designed as a crush roll which can be pressed against the other delivery roll. In this case, the web can be separated from the crushed, sticky seed particles adhering to the roll surfaces due to the crushing pressure, particularly if a fiber material of high trash content is processed into a web. Thus, web breakages due to uncontrolled tearing of web portions can be avoided. Advantageously, the web deflecting device extends in the direction of the longitudinal axis of the delivery roll over a working zone. In this manner uniform deflection and separation back to the normal path can be effected on the deflecting blade. The clearance between the web deflecting device and the delivery roll is chosen such that reliable and uniform deflection and separation of the web from the delivery roll can be ensured. To this end, the clearance is chosen according to the thickness of the web and/or according to the size of the impurities or particles, and for example can be chosen in the range of 0.1 to 0.4 mm preferably or larger.

The web deflecting can be a rotatably supported deflecting roll, which is driven in the same direction as the delivery roll, and which e.g. made of steel, is provided with a surface providing a better grip on the web, e.g. by a coat ensuring the desired grip or by a suitably knurled or fluted surface. Alternatively, the web deflecting device may be, a web deflecting blade extending in the direction of the longitudinal axis of the delivery roll and inclined against the direction of rotation of the delivery roll.

Figure 4:
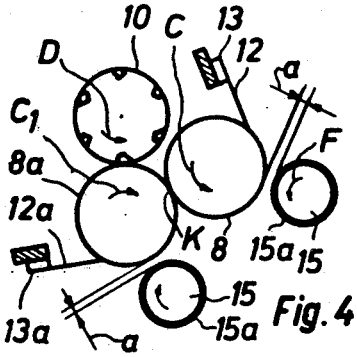
Figure 2:
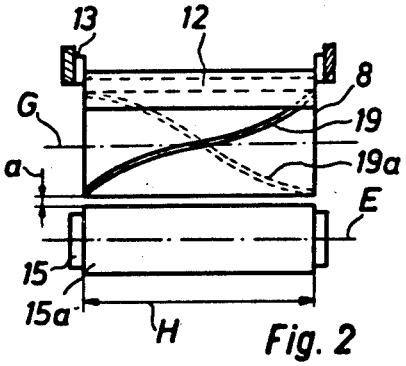
Figure 3:
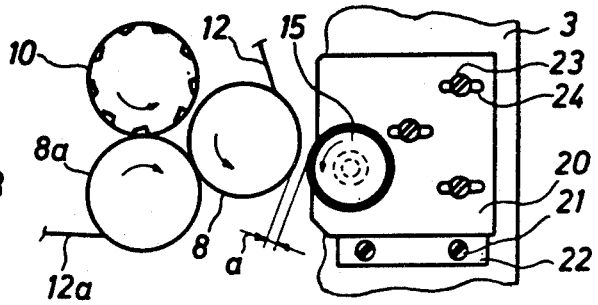
Figure 5:
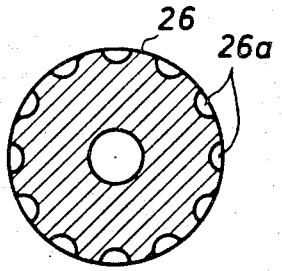
Figure 6:
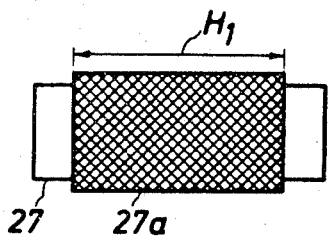
Figure 7:
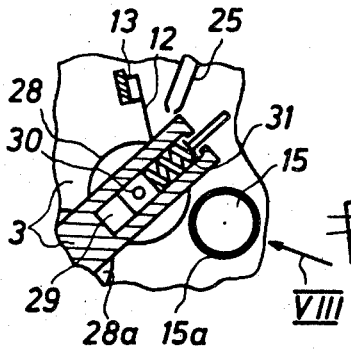
Figure 8:
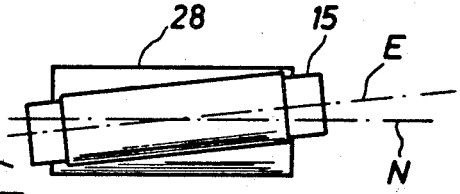
Figure 9:
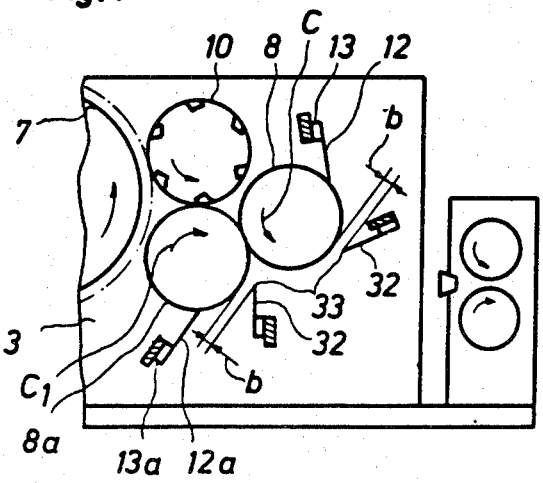

These and other objects and advantages of the invention will become more apparent from the following detailed description taken in conjunction with the accompanying drawings wherein:

FIG. 1 illustrates a schematic section of a part of a card with a web take-off apparatus according to the invention, FIG. 2 illustrates a view of a part of FIG. 1 as seen in the direction of arrow II, FIG. 3 illustrates a design example of a part of the web take-off apparatus according to FIG. 1, shown schematically in a section, FIG. 4 illustrates another design example of a part of the web take-off apparatus according to FIG. 1, shown schematically in a section, FIG. 5 illustrates a cross-sectional view of a web deflecting roll, FIG. 6 illustrates a view of a modified web deflecting roll according to the invention, FIG. 7 illustrates a part of the web take-off apparatus according to FIG. 1, shown schematically in a cross-section, FIG. 8 illustrates a view of a part of FIG. 7 as seen in the direction of arrow VIII, and FIG. 9 schematically illustrates another embodiment of a take-off apparatus according to the invention.

Referring to FIG. 1, the card has a card frame 1 with a cover 2, a main drum 5 provided with a clothing 4 and drivable in the direction of rotation A and, a doffer roll 7 provided with a clothing 6 and drivable in the direction of rotation B. The card also has a web take-off apparatus which includes a pair of delivery rollers 8, 8*a* which are drivable in opposite directions of rotation C and $C_1$ respectively, and are rotatably supported in frame walls 3 arranged on both sides of the card (one wall only being shown). The drive mechanisms for the rolls of the card, known as such, are not shown for better clarity. The delivery roll 8*a* is set so closely to the clothing points 6 of the doffer roll 7, that a web 9 is taken over correctly. The delivery roll 8 is provided with a smooth surface and with the delivery roll 8*a* (also provided with a smooth surface) forms a nip line K for the web 9 penetrating between the rolls 8 and 8*a*. A grooved roll 10 with helically extending grooves 11 is arranged above the delivery roll 8*a* which is below the nip line K. This roll 10 can be driven in the direction indicated by the arrow D and is rotatably supported to form a nip line with the delivery roll 8*a* with which the roll 10 cooperates. A means such as a grazing or scraping blade 12, 12*a*, respectively, is coordinated with both delivery rolls 8, 8*a* for grazing and eliminating impurities, each blade extending in the direction of the longitudinal axis of the corresponding delivery rolls 8 and 8*a* respectively, and contacting the cylindrical surface of the roll. The grazing blades 12 and 12*a* respectively, are arranged inclined against the direction of rotation C and $C_1$ respectively of the delivery rolls 8 and 8*a* respectively, and are mounted stationary and adjustably (not shown) on a frame part 14 and 14*a* respectively, in a support device 13 and 13*a* respectively.

On the web delivery side of the pair of delivery rolls 8,8*a* a web deflecting device in the form of roll 15 is arranged, as seen in the direction of rotation C of the delivery roll 8, between the nip line K and the grazing blade 12, in close vicinity, but at a distance a of at least 0.1 mm from the delivery roll 8. This web deflecting roll 15, as shown further in FIG. 2, is rotatable about its longitudinal axis E and can be driven in the direction of arrow F, i.e. in the same direction as the delivery roll 8. The roll 15 also extends in the direction of the longitudinal axis G of the delivery roll 8.

The web deflecting roll 15 is provided with a coat 15*a* of synthetic material, for example made of polyurethane, over a working width H, facing the delivery roll 8, which corresponds, e.g. to the width of the web processed, for increased gripping power. This coat, however, shows as little tendency of fiber adhesion as possible.

The web take-off apparatus functions as follows:

The web 9 is transferred from the main drum 5 via the doffer roll 7 to the pair of delivery rolls 8, 8*a* and from there passes along a normal predetermined path 9*a* into a condenser funnel 16 and subsequently is taken in by a pair of rolls 18, 18*a*, which are arranged in a frame part 17 and are driven in the direction of arrows L, $L_1$ and is given off as a sliver. If the web 9 upon leaving the nip line K between the delivery rolls 8 and 8*a*, e.g. sticks to the delivery roll 8, the web is carried on over the path 9*b* indicated with broken lines in FIG. 1 into the zone of the web deflecting roll 15 located closely outside the web path 9*a*, the web is then caught by the deflecting roll 15 and due to the rotation of the roll 15 is brought back to the predetermined normal path 9*a* of the web 9 to the pair of rolls 18, 18*a*. The circumferential speed of the web deflecting roll 15 in this arrangement can be equal to, or exceed by, e.g. 5% to 10%, the circumferential speed of the delivery roll 8. Any impurities, such as seed particles, trash particles or similar particles, penetrate through the small gap corresponding to the distance a between the cylindrical surface of the delivery roll 8 and the periphery of the web deflecting roll 15. These impurities thus are not caught by the web deflecting roll 15 and reach the grazing blade 12, by which the impurities are scraped off from the cylindrical surface and are eliminated in the direction of arrow M by an air stream generated by a suction device 25. In this manner, the web not only is prevented from deviating too far from its desired normal path 9*a* between the pair of delivery rolls 8, 8*a* and the pair of rolls 18, 18*a* and thus is not exposed to the danger of a web breakage, but also is separated from the impurities remaining on the delivery roll 8. The grazing blade 12*a* in this arrangement functions in analogous manner as the grazing blade 12, in such manner that the web 9 on the entry side of the pair of delivery rolls 8, 8*a* always contacts cleaned cylinder surfaces of the pair of rolls 8, 8*a*. A distance is preferably chosen between the web deflecting roll 15 and the grazing blade 12 which precludes impurities from the grazing blade 12 from being carried on by the web deflecting roll 15.

As shown furthermore in FIG. 2, two helically extending deflecting or cleaning grooves 19, 19*a* are provided in the delivery roll 8, which carry impurities accumulated on the grazing blade 12, as seen in the rotational direction C of the delivery roll 8, to the back of the grazing blade 12, from where they are eliminated, e.g. by a central suction (not shown) active there and provided as such on the card, in such manner that the grazing blade also is freed of jammed impurities. The cleaning grooves of the above mentioned type also can be provided on the lower delivery roll 8*a* for the same reasons.

The web deflecting roll 15 as shown in FIG. 3 is adjustably mounted by suitable means relative to the delivery roll 8. As shown, this means includes a bearing plate 20 provided on each side of the roll 15 for supporting the roll. Each plate 20 is adjustably guided on a support rail 22 which, in turn is screw-mounted to the frame wall 3 using screws 21, in such manner that the web deflecting roll 15 can be moved towards the delivery roll 8. For fixing the bearing plate 20 on the frame wall 3, screws 23 are provided which protrude via long bores 24 extending in the bearing plate 20 parallel to the support rail 22. These screws 23 can be adjusted to set the distance a.

Referring to FIG. 4 wherein like reference characters indicate like parts as above, a second web deflecting device in the form of the web deflecting roll 15 is coordinated to the delivery roll 8*a*, between the nip line K and the grazing blade 12*a*, the clearance a also being at least 0.1 mm between the rolls 8*a* and 15. This roll 15 however, is driven in the same direction as the delivery roll 8*a*.

A web possibly clinging to the lower delivery roll 8*a* is caught in the same manner as described for the arrangement according to FIG. 1, by the web deflecting roll 15 and whereby the web is brought back up to the desired web path, whereas the impurities can reach the grazing blade 12*a*.

Referring to FIG. 5, the web deflecting roll 26 may be provided with a fluted surface 26*a* or, as shown in FIG. 6, the web deflecting roll 27 may be provided with a knurled surface 27*a* over a working width $H_1$.

Referring to FIG. 7 wherein like reference characters indicate like parts as above, a delivery roll 28 of a pair of delivery rolls 28, 28*a* is designed as a crush roll supported in slots 29 in the frame wall 3 extending towards the center of the delivery roll 28*a*.

The delivery roll 28 is mounted in a bearing sleeve 30 at each end which is moveable in the slots 29 under the bias of a compression spring 31. The spring 31 generates the pressure which acts on a web passing the nip line between the delivery rolls 28, 28*a*.

In the design example according to FIG. 7, e.g. the web deflecting roll 15 is provided with a coat 15*a* of synthetic material. If the surface of the synthetic coat 15*a* is smooth, the web is gripped more reliably, i.e. is carried on and brought back, then if the web deflecting fluted roll 26 or knurled roll 27 is used, such that a larger clearance a can be chosen than if rolls 26 or 27 are used. In this case, an undesirable reduction of the clearance a and particularly any contact between the web deflecting roll 15 and the delivery roll 28 during the passage of a thick place in the web through the nip line K and the resulting displacement of the delivery roll 28 can be avoided. Also, the application of the grooves 19, 19*a* (FIG. 2) is advantageous if crush rolls are used, as the strongly adhering impurities are more easily eliminated.

For taking care of the possible use of a delivery roll 28 with its longitudinal axis N arranged in a crossed or in a non-crossed position with respect to the delivery roll 28*a*, the web deflecting roll can be arranged as shown in FIG. 8 with the longitudinal axis E crossed with respect to the longitudinal roll axis N in such a manner that in a crossed position as well as in the non-crossed position illustrated of the delivery roll 28, the same clearance a is maintained over the working width of the delivery roll 28. The crossed position of the web deflecting roll 15 preferably is a middle position between the non-crossed position of the delivery roll 28 according to FIG. 8 and a crossed position (not shown) of the roll 28 with respect to the delivery roll 28*a*.

Referring to FIG. 9 wherein like reference characters indicate like parts as above, the web deflecting device may be in the form of a web deflecting blade 32 arranged at each delivery roll 8, 8*a*. As indicated, the blade edge of each blade 32 is set at a distance b, which is at least 0.1 mm to the delivery roll 8 and 8*a* respectively. Each blade 32 is inclined against the direction of rotation C and $C_1$ respectively, of the delivery rolls 8 and 8*a*. A web possibly clinging to the delivery roll 8, or 8*a* respectively, is taken off by the deflecting blades 32 and the particles clinging to the delivery rolls 8 and 8*a* can reach the grazing blades 12 and 12*a* due to the clearance b, where they are eliminated as described with reference to the aforementioned design examples.

We claim:

1. A card comprising a doffer roll for doffing of a fibrous web therefrom;

a pair of delivery rolls for delivering the doffed web from said doffer roll into a predetermined normal path, said delivery rolls forming a nip line for passage of a doffed web therethrough from said doffer roll;

a condenser funnel for receiving the web delivered from said delivery rolls along said predetermined normal path; and a web deflecting device between said delivery rolls and said condenser funnel, said web deflecting device being spaced from at least one of said delivery rolls at a distance of at least 0.1 millimeters and spaced from said predetermined normal path whereby a web carried on said one delivery roll downstream of said nip line is caught by said deflecting device and brought back to said predetermined normal path.

2. A card as set forth in claim 1 wherein said deflecting device is a rotatably driven roll.

3. A card as set forth in claim 1 wherein said deflecting device is a deflecting blade.

4. A card as set forth in claim 1 which further includes means for adjustably mounting said deflecting device relative to said one delivery roll.

5. A card as set forth in claim 1 which further comprises means adjacent said one delivery roll for eliminating impurities from said one delivery roll, said means being disposed downstream of said nip line and spaced from said deflecting device.

6. A card as set forth in claim 1 which further comprises a second web deflecting device spaced from the other of said delivery rolls at a distance of at least 0.1 millimeters and spaced from said predetermined normal path whereby a web carried on said other delivery roll downstream of said nip line is caught by said deflecting device and brought back to said predetermined normal path.

7. A web take-off apparatus for a card having a doffer roll, said apparatus comprising a pair of delivery rolls for delivering a doffed web from the doffer roll into a predetermined normal path, said delivery rolls forming a nip line for passage of a doffed web therethrough from said doffer roll; and a web deflecting device spaced from at least one of said delivery rolls at a distance of at least 0.1 millimeters and spaced from said predetermined normal path whereby a web carried on said one delivery roll downstream of said nip line is caught by said deflecting device and brought back to said predetermined normal path.

8. A web take-off apparatus as set forth in claim 1 which further comprises means adjacent said one delivery roll for eliminating impurities from said one delivery roll, said means being disposed downstream of said nip line and spaced from said deflecting device.

9. A web as set forth in claim 8 wherein said means for eliminating impurities is a stationary grazing blade.

10. A web as set forth in claim 9 wherein said grazing blade contacts a cylindrical surface on said one delivery roll.

11. A web take-off apparatus as set forth in claim 10 wherein said one delivery roll has a helically extending cleaning groove in said cylindrical surface.

12. A web take-off apparatus as set forth in claim 1 wherein said web deflecting device is a rotatably supported web deflecting roll extending in the direction of the longitudinal axis of said one delivery roll.

13. A web take-off apparatus as set forth in claim 12 wherein said web deflecting roll has a cylindrical surface and a coat of synthetic material on said surface.

14. A web take-off apparatus as set forth in claim 1 wherein said web deflecting device is a stationary deflecting blade extending in the direction of the longitudinal axis of said one delivery roll and arranged against the direction of rotation of said one delivery roll.

15. A web take-off apparatus as set forth in claim 1 wherein said web deflecting devide is arranged at a distance ranging from 0.1 to approximately 0.4 millimeters from said one delivery roll.

16. A web take-off apparatus as set forth in claim 1 wherein one of said delivery rolls is a crush roll which is adapted to be loaded with respect to the other delivery roll.

17. A web take-off apparatus as set forth in claim 1 which further comprises a second web deflecting device spaced from the other of said delivery rolls at a distance of at least 0.1 millimeters and spaced from said predetermined normal path whereby a web carried on said other delivery roll downstream of said nip line is caught by said deflecting device and brought back to said predetermined normal path.

* * * * *

UNITED STATES PATENT AND TRADEMARK OFFICE

CERTIFICATE OF CORRECTION

PATENT NO. : 4,299,011

DATED : November 10, 1981

INVENTOR(S) : Hansjoerg Rothen, et al

It is certified that error appears in the above—identified patent and that said Letters Patent is hereby corrected as shown below:

Col. 2, line 6, after "manner" insert a --,--.

Col. 2, line 16, after "deflecting" insert --device--.

Col. 2, line 54, change "rotation A and," to --rotation A, and--.

Col. 2, line 56, begin new paragraph with "The card also...".

Col. 3, line 19, after "form of" insert --a--.

Col. 3, line 22, after "distance" underscore "a".

Col. 3, line 48, after "9a" change ", the" to --. The--.

Col. 4, line 34, underscore "a".

Col. 4, line 38, after "8a" delete ",".

UNITED STATES PATENT AND TRADEMARK OFFICE

CERTIFICATE OF CORRECTION

PATENT NO. : 4,299,011

DATED : November 10, 1981

INVENTOR(S) : Hansjoerg Rothen, et al

It is certified that error appears in the above—identified patent and that said Letters Patent is hereby corrected as shown below:

Col. 6, line 26, after "claim" change "1" to --7--.

Col. 6, line 39, after "claim" change "1" to --7--.

Col. 6, line 46, after "claim" change "1" to --7--.

Col. 6, line 51, after "claim" change "1" to --7--.

Col. 6, line 55, after "claim" change "1" to --7--.

Col. 6, line 59, after "claim" change "1" to --7--.

Signed and Sealed this

*Sixth* Day of *April 1982*

[SEAL]

*Attest:*

GERALD J. MOSSINGHOFF

*Attesting Officer* *Commissioner of Patents and Trademarks*